US005749568A

United States Patent [19]

Reist

[11] Patent Number: 5,749,568

[45] Date of Patent: May 12, 1998

[54] APPARATUS AND METHOD FOR SUPPLYING PRINTED PRODUCTS TO A PROCESSING SECTION

[75] Inventor: Walter Reist, Hinwil, Switzerland

[73] Assignee: Ferag AG, Hinwil, Switzerland

[21] Appl. No.: 540,546

[22] Filed: Oct. 6, 1995

[30] Foreign Application Priority Data

Oct. 27, 1994 [CH] Switzerland ..... 03215/94

[51] Int. Cl.[6] ..... B65H 3/44

[52] U.S. Cl. ..... 271/9.01; 271/157; 271/163

[58] Field of Search ..... 271/3.01, 3.14, 271/9.01, 9.03, 163, 216, 157, 158, 159

[56] References Cited

U.S. PATENT DOCUMENTS

| | | | |
|---|---|---|---|
| 4,000,806 | 1/1977 | Dietrich et al. . | |
| 4,274,623 | 6/1981 | Reist et al. . | |
| 4,525,982 | 7/1985 | Meier . | |
| 4,587,790 | 5/1986 | Müller . | |
| 4,676,496 | 6/1987 | Honegger . | |
| 4,752,176 | 6/1988 | Linder . | |
| 4,768,768 | 9/1988 | Reist | 271/216 X |
| 5,022,807 | 6/1991 | Linder . | |

FOREIGN PATENT DOCUMENTS

| | | | |
|---|---|---|---|
| 652425 | 9/1992 | Austria | 271/216 |
| 2 517 652 | 6/1983 | France . | |
| 2 631 011 | 11/1989 | France . | |
| 33 29 627 | 4/1984 | Germany . | |
| 36 02 320 | 8/1986 | Germany . | |
| 577 929 | 7/1976 | Switzerland . | |

*Primary Examiner*—David H. Bollinger
*Attorney, Agent, or Firm*—Brinks Hofer Gilson & Lione

[57] ABSTRACT

An apparatus and method are disclosed for supplying printed products to a preferably continuously operating processing section with a plurality of stations. The stations may be feeding stations and each feeding station is assigned a buffer. Each buffer is provided with an arrangement for discharging printed products onto the processing section and can be charged via a mobile supply device. The supply device is designed for the transportation of a storage unit (i.e. a reel) containing a number of printed products. The supply device includes drive and conveying arrangements for the sequential charging of the buffers at a predeterminable conveying speed. The conveying speed is greater than the discharge speed at which the printed products are transferred from the buffers onto the processing section.

17 Claims, 4 Drawing Sheets

APPARATUS AND METHOD FOR SUPPLYING PRINTED PRODUCTS TO A PROCESSING SECTION

BACKGROUND OF THE INVENTION

The present invention relates to an apparatus and a method for supplying printed products to a processing section with a number of stations. Each station is assigned a buffer which is provided with means for discharging printed products onto the processing section. The buffer can be charged with a mobile supply device which can transport a storage unit containing a number of printed products.

An apparatus of this type is known, for example in U.S. Pat. No. 4,676,496 and the corresponding EP-A-0 149 058. The apparatus disclosed in this reference includes a processing section with a plurality of feeding stations which are arranged one beside the other and are each assigned a buffer. The buffers are equipped with drive means suitable for conveying those printed products which are stored intermediately in the buffer to a withdrawal location where the printed products are transferred onto the processing section.

A supply device can be coupled at that end of each buffer which is directed away from the processing section.

The supply device is designed so that it is suitable for receiving a reel on which a number of printed products are wound up and stored in imbricated formation.

Upon coupling the supply device to a buffer, the drive means of the buffer is simultaneously coupled to the drive means for the reel mounted on the supply device. As a result, the reel rotates and the printed products on the reel are transferred onto the buffer.

In the apparatus described in U.S. Pat. No. 4,676,496, one supply device has to be coupled to each buffer during virtually the entire operating period. It is only when a supply device with an empty reel is exchanged for a supply device with a full reel that the buffer is operated for a brief period without a coupled supply device.

This results in at least one separate supply device having to be provided for each buffer or for each feeding station. Since each of these supply devices has to be operated by the operating staff, the operation of this known apparatus is possible only with a comparatively high degree of outlay.

Therefore, it is an object of the invention to provide an apparatus which makes it possible to operate as many stations as possible (i.e. feeding stations, supply stations or processing stations), with the lowest possible degree of outlay.

SUMMARY OF THE INVENTION

This object is achieved by a preferred embodiment of an apparatus according to the invention in which the supply device includes a drive and conveying device for the respectively intermittent charging of the buffers with printed products at a predeterminable conveying speed. This conveying speed is greater than the discharge speed at which the printed products are transferred from the buffers onto the processing section.

The object is further achieved by a preferred embodiment of a method according to the invention in which the charging of the buffer via the storage unit takes place with a higher throughput over time of printed products than the charging of the processing section via the buffer.

According to the preferred embodiment of the apparatus and process, therefore, the charging of the buffers takes place at a higher speed than the charging of the processing section. This results in the buffer being loaded more quickly than it is unloaded. In order to load the buffer with a specific number of printed products, less time is thus needed for charging the buffer than for charging the processing section with a corresponding number of printed products. The charging of a buffer, therefore, does not take place continuously, but only intermittently in each case.

The speed ratios outlined above result in only a comparatively short period of time being required for the emptying (into the buffer) of a storage unit coupled to a supply device. Consequentially, the supply device also only has to be coupled to the buffer for a comparatively short period of time and is available for other operations in the remaining period of time.

In practice, this advantageously makes it possible to serve a larger number of stations and buffers with a single supply device. For this purpose, only a single operator is needed to control the supply device (i.e. the supply device can be coupled to a steerable carriage or can be designed as a steerable carriage).

BRIEF DESCRIPTION OF THE DRAWINGS

The invention is described below by way of examples, with reference to the drawings.

DETAILED DESCRIPTION OF THE PRESENTLY PREFERRED EMBODIMENTS

Figure 1:
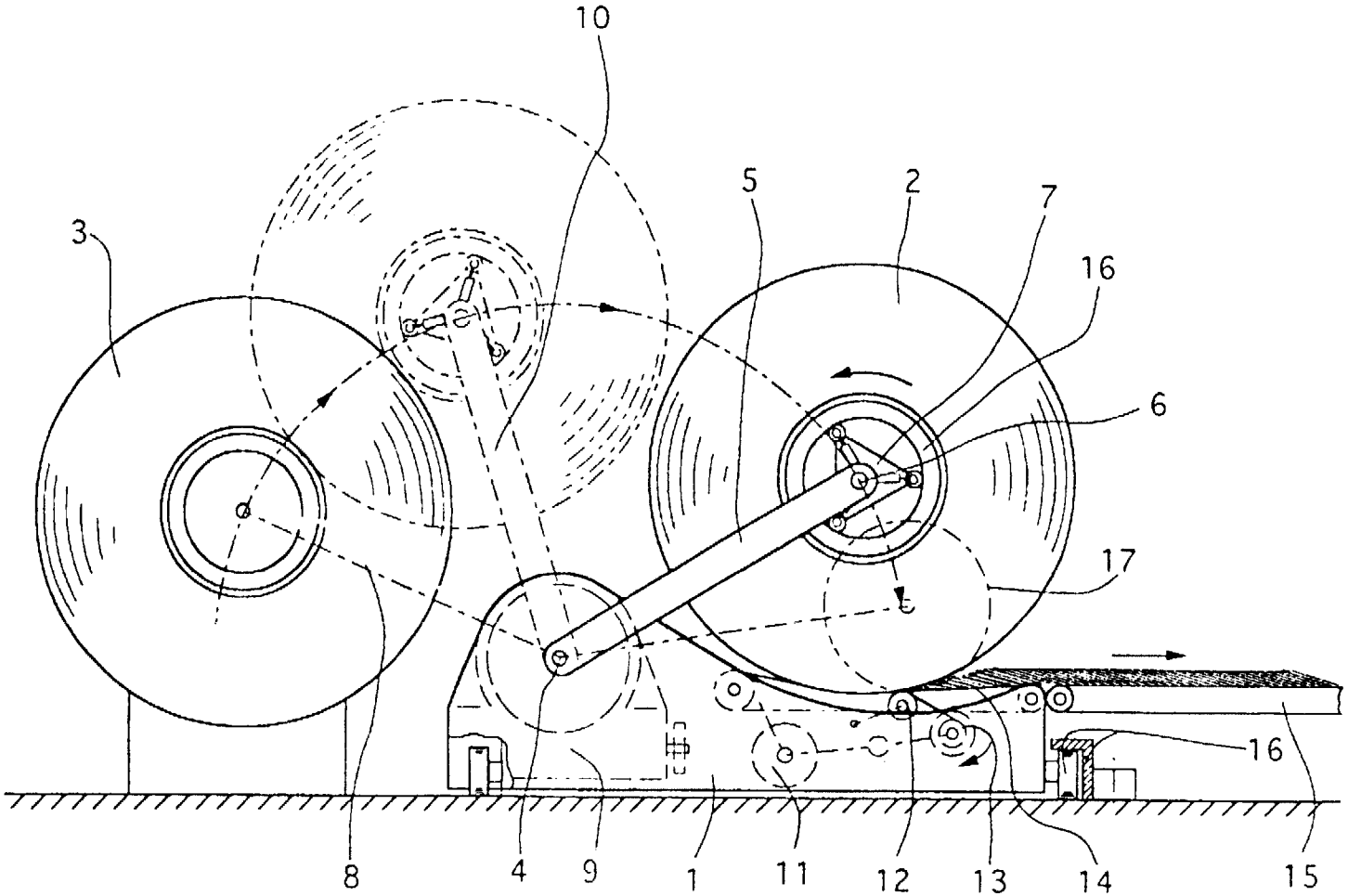
FIG. 1 shows an embodiment of a supply device operating upon receiving a full storage unit.

FIG. 1 shows a supply device 1 which can be displaced freely or on rails and is suitable for receiving a reel 2, 3 onto which printed products are wound in imbricated formation.

The supply device 1 is provided with an arm 5 which can be pivoted about an axis 4 between a loading position and an unloading position. A receiving element 7 is mounted on that end of arm 5 which is directed away from axis 4. The receiving element 7 can be rotated about an axis 6 and is intended for a reel 2, 3.

Upon receiving a full reel 2, 3, the arm 5 is located in the loading position indicated in broken lines by 8 in FIG. 1. After a full reel 2, 3 has been received, the arm 5 is pivoted, by a drive 9 arranged in the supply device 1, from the loading position 8 (via the intermediate position 10 indicated in broken lines), into the position which is depicted in solid lines in FIG. 1. At this latter position, reel 2 is driven in the direction of the arrow in order to unwind the printed products stored in imbricated formation. A drive 11, which makes the reel 2 rotate, is also arranged in the supply device 1.

The imbricated formation, wound up helically onto a reel 2, 3, is retained there in each case by a winding band. When the imbricated formation is unwound from the reel 2, the winding band is wound up onto a band spool 13 via a band-release roller 12. In this arrangement, the band spool 13 is also activated by the drive 11.

When the printed products are unwound from the reel 2, the printed products are transported in imbricated formation over a short section by a conveying device 14 which is attached to the supply device 1. The conveying device 14 (for example, a conveying belt) can be connected to a conveying device 15 which is in connection with a feeding station and/or a buffer. The conveying device 15 conveys away the printed products in imbricated formation from the supply device 1.

During the unwinding of the imbricated formation from the reel 2, the supply device 1 is fixed in its position with respect to the processing section (not shown in FIG. 1) by stop elements.

After the reel 2 has been fully unwound, its winding core 16 is located in the position indicated by 17. During the unwinding operation, the arm 5 is rotated in the clockwise direction through an angle of approximately 20° out of the position depicted in solid lines in FIG. 1.

Figure 2:
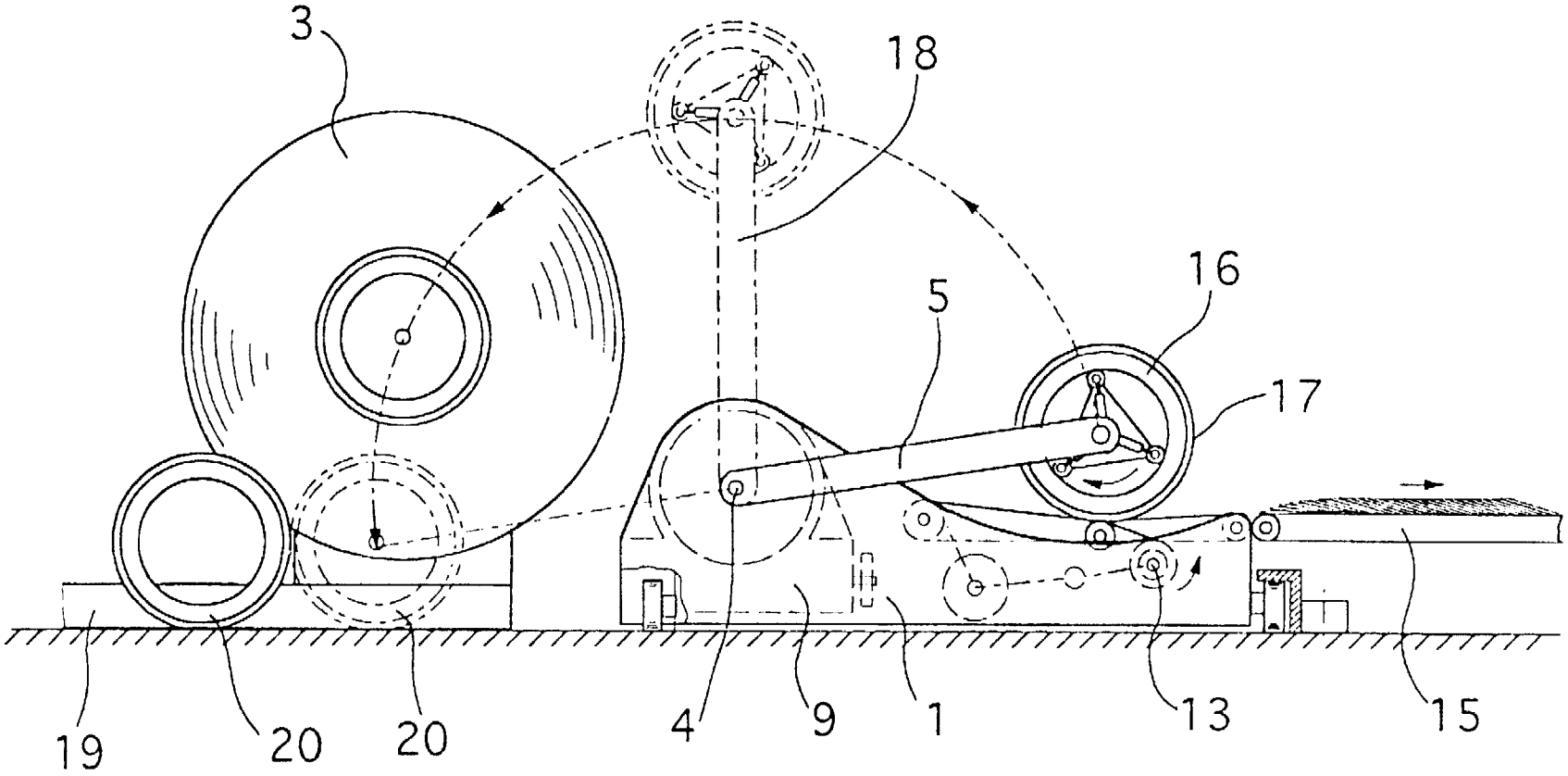
FIG. 2 shows a supply device operating, according to FIG. 1, upon depositing an empty storage unit.

That operating position in which the winding core 16 is located in the position 17 is represented in FIG. 2.

After the reel 2 has been fully unwound, the winding core 16 is driven in the arrow direction counter to the unwinding direction. This results in the winding band being wound up from the band spool 13 onto the empty winding core 16. Alternatively, it would also be possible to remove the full band spool 13 from the supply device 1 and to replace it with an empty band spool.

After the winding band has been fully wound up onto the empty winding core 16, the arm 5 is pivoted in the counterclockwise direction about the axis 4, in the arrow direction (via the intermediate position 18 indicated in broken lines). The pivot operation is again being effected by the drive 9.

In this arrangement, the arm 5 is pivoted approximately through 180° to such an extent that the empty winding core 16 comes to bear in a receiving channel 19 for storing and conveying away empty winding cores 20.

The rewinding of the winding band from the band spool 13 onto the empty winding core 16 and the subsequent pivoting of the arm 5 can take place during the period over which the supply device 1 is moved from the conveying device 15 to the unloading position (where the empty winding core 16 is also deposited).

After both the pivoting of the arm 5 and the empty winding core 16 has been deposited in a receiving channel 19 (and, if appropriate, after the displacement of the supply device 1 into an unloading position), the arm 5 is pivoted again into the loading position designated by 8 in FIG. 1. The supply device 1 is, if appropriate, displaced into a receiving position, in which a full winding core 3 can then be received again. Subsequently, the supply device 1 is moved away from the receiving position and advanced up to the conveying device 15, where the unwinding operation (described with reference to FIG. 1) can then take place.

Figure 3:
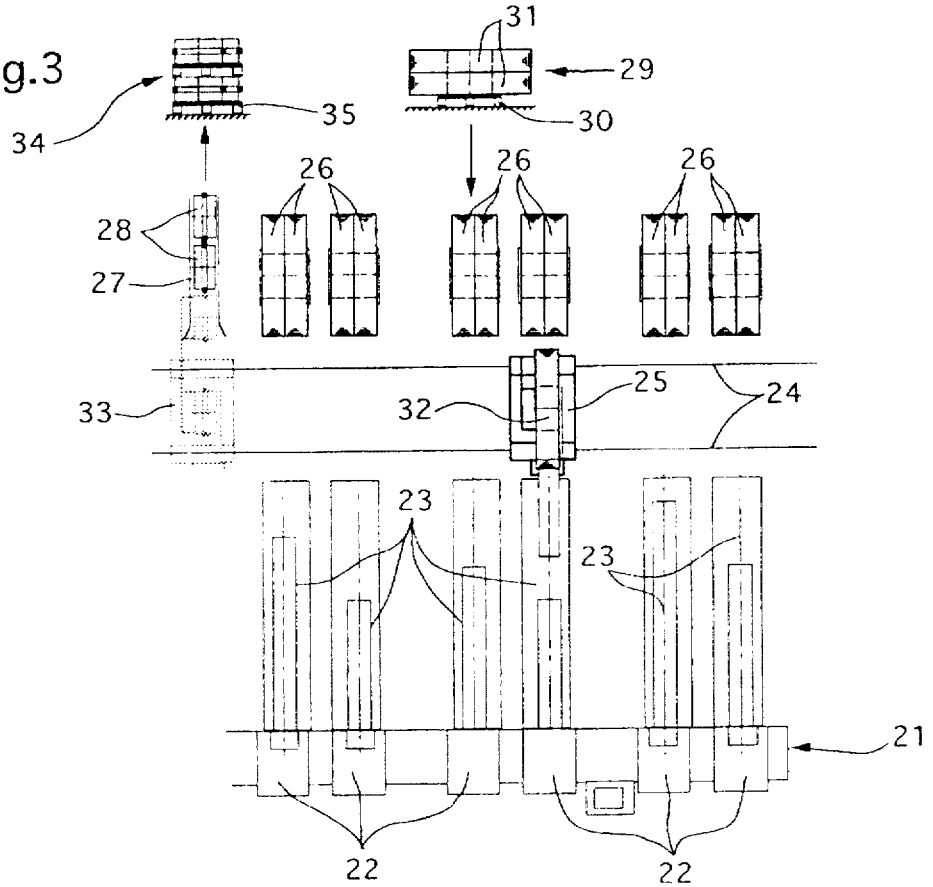
FIG. 3 shows a possible embodiment of an apparatus according to the invention.

FIG. 3 shows a possible embodiment of an apparatus operating according to the invention. A continuously operating processing section 21 is equipped with six feeding stations 22, which are each assigned a buffer 23. In this arrangement, the processing section 21 may be suitable, for example, for the inserting, collecting, collating, cutting and/or stapling of printed products.

Provided on that side of the buffer 23 which is directed away from the processing section 21 are rails 24 along which there may be displaced supply device 25 (which may be designed, for example, according to FIGS. 1 and 2).

On that side of the rails 24 which is directed away from the buffers 23, a plurality of reels 26 are arranged in a standby position. In the arrangement shown, each buffer 23 is assigned two reels 26 which are located in the standby position. Each reel 26 is situated on the opposite side of the rails 24, relative to the respective buffer 23.

Provided offset in the rail direction with respect to the reels 26 located in the standby position is a receiving channel 27 in which empty winding cores 28 can be deposited.

The arrangement shown in FIG. 3 is operated as follows:

A pair of reels 31 is mounted horizontally in a store position 29 on pallets 30 and is conveyed into the above-mentioned standby positions by means of a suitable transporting medium. During the transporting operation, the pairs of reels 31 are pivoted out of their horizontal position into a vertical position.

When a buffer 23 has been emptied (via the feeding stations 22), to such an extent that the free storage capacity of the buffer 23 is large enough for receiving the printed products of a reel 26, the supply device 25 is displaced into the position assigned to the respective buffer 23. In this position, a reel 26 is then received from the standby position.

Thereafter, the reel 32 received by the supply device 25 is connected to the buffer 23 via a conveying device arranged on the supply device 25. In this position, unwinding of the reel 32 (and thus charging of the buffer 23 with printed products) takes place.

If required, it is possible not to unwind a reel 32 fully on a buffer 23, but to charge a buffer 23 merely with some of the printed products stored on a reel 32. The printed products remaining on the reel 32 may then be conveyed into another buffer 23, after a corresponding displacement of the supply device 25.

It is essential that the charging of a buffer 23 with printed products stored on a reel 32 takes place at a higher speed than the emptying of the relevant buffer 23 or the charging of the processing section 21 (which takes place via the buffer 23). This speed ratio produces the previously described advantages according to the invention.

After the reel 32 has been fully emptied, the supply device 25 is displaced into a position 33 which is located opposite the receiving channel 27 (represented in broken lines in FIG. 3). While in position 33, the empty winding core is discharged into the receiving channel 27.

From the receiving channel 27, the empty winding cores 28 are conveyed into a storage position 34 in which they are mounted on pallets 35. While in the storage position 34, the empty winding cores 28 are located horizontally, one above the other.

After the empty winding core has been discharged into the receiving channel 27 in the unloading position 33, the supply device 25 can receive a new reel 26 located in the standby position. The supply device 25 can then discharge those printed products which are stored in the standby position to a further buffer 23.

Figure 4:
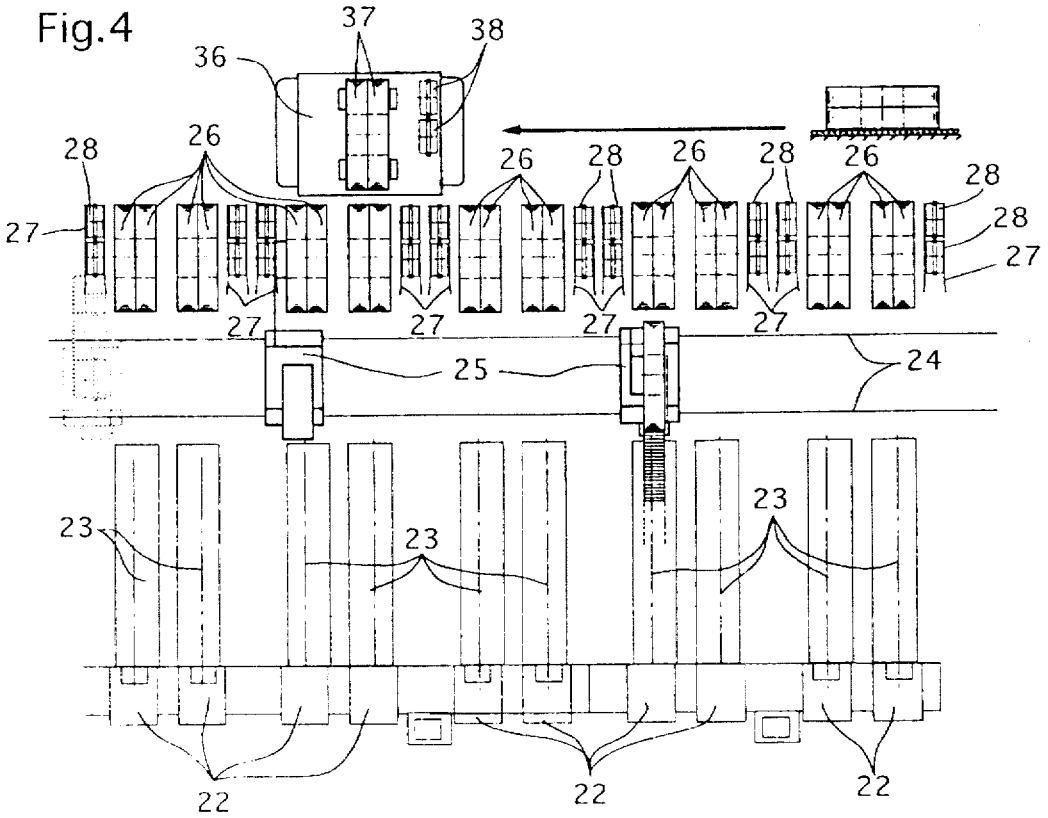
FIG. 4 shows a further possible embodiment of an apparatus according to the invention.

FIG. 4 shows an apparatus which essentially corresponds to FIG. 3 and is suitable for serving a larger number of feeding stations 22 and buffers 23. In contrast to FIG. 3, however, two supply devices 25 can be displaced along the rails 24 here.

As is also the case in an apparatus according to FIG. 3, on that side of the rails 24 which is located opposite each buffer 23, a pair of reels 26 is mounted in a standby position. Corresponding to the arrangement of the buffers 23 in FIG. 4, each two pairs of reels 26 are arranged adjacent to one another. Two adjacent receiving channels 27 for receiving empty winding cores 28 are provided between each two pairs of reels 26. In this manner, one receiving channel 27 is available for each pair of reels.

Provided on that side of the reels 26 which is located opposite the rails 24 is a displaceable conveying device 36 (located in the standby position). The displacement conveying device 36 is suitable both for conveying pairs of full reels 37 out of a storage position into a standby position and for conveying empty winding cores 38 from the receiving channels 27 into a storage position.

Figure 5:
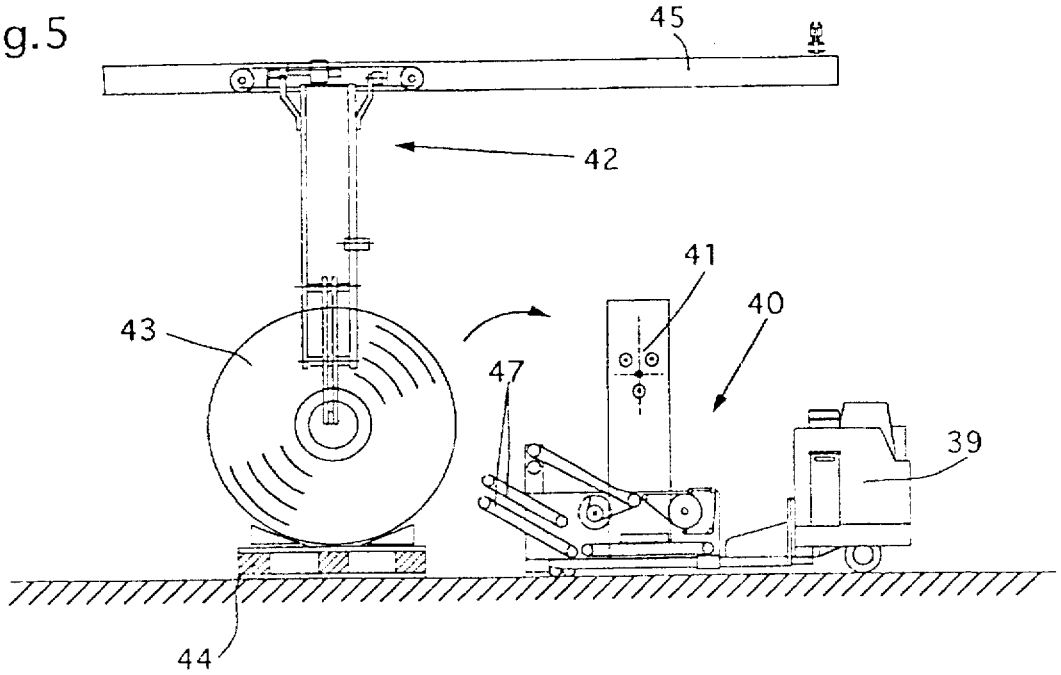
FIG. 5 shows a supply device which can be used in the loading position.

FIG. 5 shows a supply device 40 which is equipped with a control cabin 39 and is provided with a receiving element 41 for a reel.

The supply device 40 is located in the region of a handling apparatus 42. Handling apparatus 42 is suitable for lifting a loaded reel 43 from a pallet 44 and conveying it in the arrow direction, via guide rails 45, to the supply device 40. The supply device 40 then receives the loaded reel 43 from the handling apparatus 42, by way of suitable gripping means of its receiving element 41.

Thereafter, the loaded reel 43 can be displaced, by means of the supply device 40, and connected to a buffer (not shown in FIG. 5). Once loaded reel 43 is connected to the buffer, unwinding of the printed products from the reel 43 (and thus charging of the buffer) can be initiated.

Figure 6:
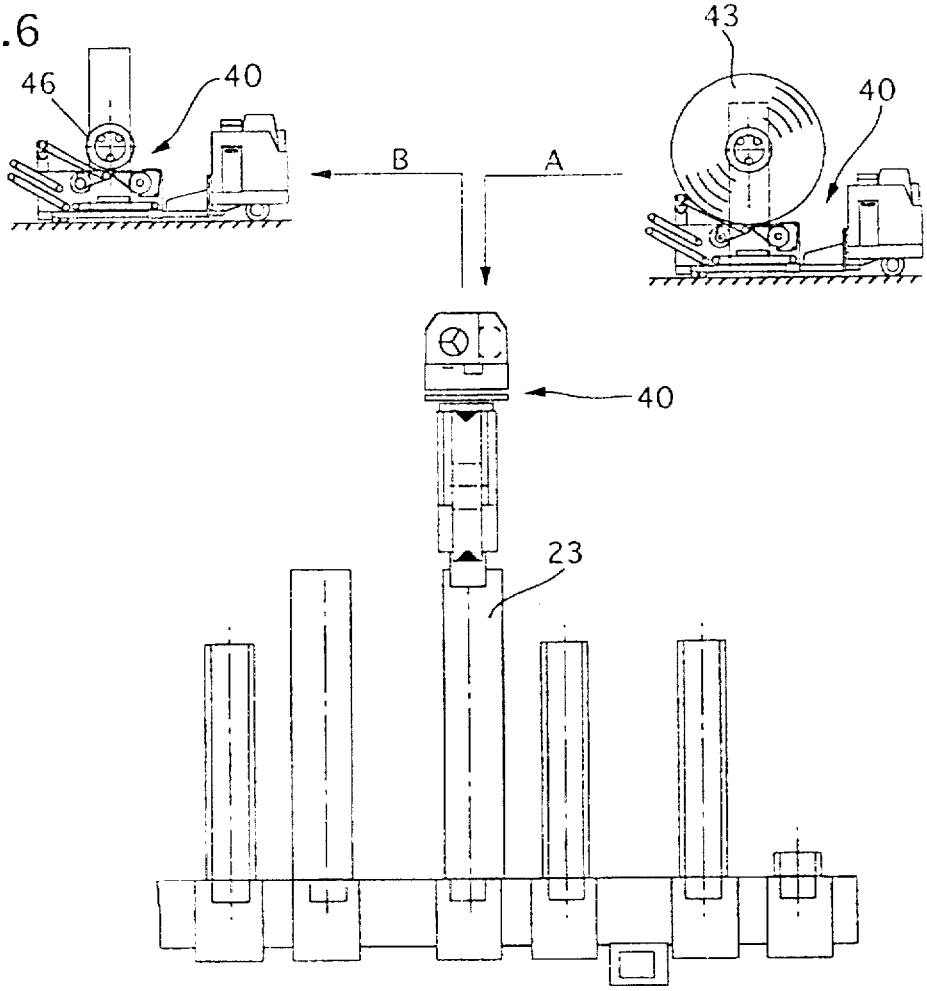
FIG. 6 shows a supply device which can be displaced between a loading position, a buffer and an unloading position.

FIG. 6 shows the transporting path which has to be covered by a supply device 40 according to FIG. 5.

In FIG. 6, the supply device 40 loaded with a full reel 43 (by way of the handling apparatus 42 according to FIG. 5) is displaced, along arrow A, from a loading position in the direction of a buffer 23 and is connected thereto. The unwinding operation then begins, in which the printed products stored on the reel 43 are conveyed between the guide elements 47 (FIG. 5) in the direction of the buffer 23. The unwinding and conveying operation takes place at a high speed, with the result that the buffer 23 can be loaded in the minimum possible time.

After the printed products have been fully unwound, the supply device 40 is displaced along arrow B into an unloading position, in which the now empty winding core 46 is deposited and stored. Thereafter, the supply device 40 can be displaced to the handling apparatus 42 again, where it can be loaded with a new full reel.

In the manner described, discontinuously operating processing sections may also be supplied with printed products.

The stations of the processing sections may not only be feeding stations, but also, for example, supplying stations, processing stations and the like.

The preferred embodiments which are outlined above with reference to a processing section comprising a plurality of stations may also be used for a processing section with only one station. Similarly, the buffer of the sole station is supplied, via a mobile supply device, with printed products at a supply speed which is greater than the speed at which the printed products are transferred from the buffer onto the processing section.

Accordingly, it is possible to design the supply device as a vehicle which can be displaced along the feeding stations on rails and is moved, for example, in a remote-controlled or computer-controlled manner. Also, in this case, a single supply device suffices for serving a comparatively large number of stations. Moreover, in the case of computer-controlled movement of the supply device, the apparatus can be operated without any operating staff.

In particularly large installations, there is also the possibility of using two or more supply devices operating according to the preferred embodiments.

The supply devices are preferably designed as autonomous units which are equipped with all the means required for moving the supply device and conveying the printed products to the buffer from the storage unit coupled to the supply device. The means for receiving a full storage unit and for discharging an empty storage unit may either form a constituent part of the supply device or be arranged externally.

It is advantageous if the storage capacity of the buffers is at least as large as the storage capacity of the storage unit which can be transported by the supply device. In this case, the storage unit can be emptied at the maximum possible speed.

In this arrangement, it is also possible to select the storage capacity of the buffer to be of such a magnitude that the printed products of a plurality of storage units can be stored intermediately in a buffer.

The storage unit which can be transported by the supply device may be designed, for example, as a reel, a wound cartridge (in particular according to U.S. Pat. No. 4,587,790 or DE-A-32 36 866, or a tower stack (in particular according to U.S. Pat. No. 4,274,623 and CH-A-570 920 or U.S. Pat. No. 4,000,806 and CH-A-577 929.

I claim:

1. An apparatus for supplying printed products to a processing section having a plurality of stations, the apparatus comprising:

a buffer assigned for each respective station, each buffer including means for discharging printed products onto the processing section at a discharge speed;

a mobile supply device having a storage unit for holding a plurality of printed products, a drive for the storage unit, and a conveying device for removing printed products from the storage unit at a conveying speed, the mobile supply device being temporarily connectable to one of the buffers for intermittently charging that buffer with printed products at the conveying speed;

the conveying speed being greater than the discharge speed.

2. An apparatus according to claim 1, wherein the storage capacity of the buffers is at least as large as the storage capacity of the storage unit.

3. An apparatus according to claim 1, wherein the mobile supply device includes a receiving element for receiving loaded storage units and for discharging empty storage units.

4. An apparatus according to claim 1, wherein the mobile supply device further comprises a steerable carriage.

5. An apparatus according to claim 1, wherein the mobile supply device is guided on rails.

6. An apparatus according to claim 1, wherein the printed products are stored in imbricated formation in the storage unit of the mobile supply device.

7. An apparatus according to claim 1, wherein the storage unit of the mobile supply device comprises a reel.

8. An apparatus according to claim 1, wherein the storage unit of the mobile supply device comprises a wound cartridge.

9. An apparatus according to claim 1, wherein the storage unit of the mobile supply device comprises a tower stack.

10. An apparatus according to claim 1, wherein the mobile supply device further comprises an arm with a first end and a second end opposite the first end, the arm being pivotable about the first end between a loading position and an unloading position, and the storage unit is releasably mounted on the second end of the arm.

11. An apparatus according to claim 1, wherein the storage unit of the mobile supply device comprises a reel, and the mobile supply device further includes a spool for receiving a winding band and a device for rewinding the winding band onto an empty winding core.

12. A method for supplying printed products to a processing section with a plurality of stations that are each assigned a buffer, the method comprising the steps of:

loading a supply device with a storage unit containing a plurality of printed products;

connecting the supply device to a buffer;

charging the buffer with printed products contained in the storage unit;

supplying the processing section with the printed products stored temporarily in the buffer; and wherein the charging of the buffer from the storage unit takes place with a higher throughput of printed products over time than the charging of the processing section from the buffer.

13. The method according to claim 12, further comprising the step of connecting the supply device to the buffer only over the period of time during which the buffer is being charged.

14. The method according to claim 12, further comprising the step of supplying a plurality of buffers with printed products from one supply device.

15. The method according to claim 12, further comprising the step of storing printed products in the buffer at the time of charging a buffer.

16. The method according to claim 12, further comprising the step of storing the printed products temporarily in the buffer in imbricated formation.

17. The method according to claim 12, further comprising the steps of displacing the supply device between a loading position, the buffers, and an unloading position, receiving a full storage unit in the loading position, and depositing an empty storage unit in the unloading position.

* * * * *